United States Patent [19]

Sacks

[11] Patent Number: 4,928,452

[45] Date of Patent: May 29, 1990

[54] BUILDING STRUCTURE

[76] Inventor: Charles H. Sacks, c/o Hallandale Rehabilitation Center, 2400 E. Hallandale Beach Blvd., Hallandale, Fla. 33009

[21] Appl. No.: 329,767

[22] Filed: Mar. 28, 1989

[51] Int. Cl.[5] ..... E04H 1/00

[52] U.S. Cl. ..... 52/236.3

[58] Field of Search ..... 52/236.3, 234, 79.1, 52/236.4

[56] References Cited

U.S. PATENT DOCUMENTS 2,390,179 12/1945 Sacks .
2,698,973 12/1949 Zeckendorf et al. .
3,302,340 2/1967 Chertkof .
3,656,266 4/1972 Tylius .
3,750,354 8/1973 Boros .
3,884,001 5/1975 Tylius .

*Primary Examiner*—Carl D. Friedman

*Attorney, Agent, or Firm*—Herbert L. Lerner; Laurence A. Greenberg

[57] ABSTRACT

A multi-story building structure includes at least one pair of levels. Each pair of levels includes one sleeping level, one living level and one public corridor on the living level. The levels include duplex apartments with at least one room on the sleeping level and at least one room on the living level of a respective pair of levels. An elevator system includes two elevators. Each of the elevators has a respective stop disposed at each one of the public corridors and each of the elevators skips the sleeping levels.

20 Claims, 4 Drawing Sheets

BUILDING STRUCTURE

BACKGROUND OF THE INVENTION

1. Field of the Invention

The invention relates to a building structure and, more particularly, to a multi-story building structure with at least one pair of levels including a living level and a sleeping level.

2. Description of the Related Art

Several types of multi-story building structures have been proposed. In particular, U.S. Pat. Nos. 2,698,973 to Zeckendorf et al, 3,302,340 to Chertkof, 3,656,266 to Tylius, 3,750,354 to Boros, and 3,884,001 to Tylius all disclose multi-level building structures with units occupying more than one level in split-level fashion, i.e. there exist half-level elevational differences between rooms of one and the same apartment unit. U.S. Pat. No. 2,390,179 to the inventor of the instant application discloses a building construction with apartments occupying two or more levels, with the sleeping area of an apartment unit disposed directly above or below the respective living area of the same apartment unit. U.S. Pat. No. 2,390,179 discloses a U-shaped floor plan with a public corridor disposed along the inside walls of the building, and thereby taking up an entire flight of possible outside exposure walls, which could otherwise be utilized as exposure walls for apartment units.

It is therefore seen that it is a disadvantage of all the prior art that available space is not properly utilized for habitable areas but is instead assigned to public areas such as corridors and the like. Another problem with multi-story building structures lies in the fact that only few of the apartment units have more than one outside exposure wall, i.e. only few apartments offer cross-ventilation or even through-ventilation. Buildings in accordance with the prior art are replete with short-comings and disadvantages which are overcome by the invention of the instant application, as shown in the following description.

SUMMARY OF THE INVENTION

It is accordingly an object of the invention to provide a building structure, which overcomes the hereinaforementioned disadvantages of the heretofore-known devices of this general type. Some of the advantageous features, which will be described in detail in the following, are the "overlapping feature" between apartment units, the multi-elevator system with skip-stop, the back-to-back disposition of apartment units so as to access one plumbing stack from several units, through-ventilation in the duplex apartments and cross-ventilation in the simplex apartments.

With the foregoing and other objects in view there is provided, in accordance with the invention, a multi-story building structure, comprising at least one pair of levels, each pair of levels including one sleeping level, one living level and one public corridor on the living level, duplex apartments each having at least one room on said sleeping level and at least one room on the living level of a respective pair of levels, and an elevator system including two elevators, each of the elevators having a respective stop disposed at each one of the public corridors and each of the elevators skipping the sleeping levels.

In accordance with another feature of the invention, the vertical succession of the individual levels is such that a pair of living and sleeping levels is followed by a pair of sleeping and living levels in reverse vertical order, i.e. the succession of levels may be described as living-sleeping, sleeping-living, living- sleeping, etc., the number of pairs depending on the number of stories of the building.

In accordance with a further feature of the invention, each of the levels contains at least two simplex apartments. The building in accordance with the invention of the instant application thus offers a complete array of small to mid-size to large apartment units. The simplex apartments on the living levels are accessible directly from a public corridor, while the simplex apartments disposed on the sleeping levels are accessed via staircases from the public corridor either one level above or one level below.

In accordance with yet an added feature of the invention, the public corridor on the living level is disposed centrally between the apartment units; this makes full use of practically all of the outside exposure wall space for habitable areas.

In accordance with an additional feature of the invention, the horizontally adjacent apartment units are arranged in such an order that each plumbing and vent stack disposed in a wall between the two apartments is accessed from at least these two apartments. The advantageously economical use of plumbing stacks, which may include soil lines, air vents, water supply lines and electrical conduits, lowers the cost of a building in accordance with the invention of the instant application substantially.

In accordance with yet a further feature of the invention, the apartments are arranged in an overlapping fashion. Accordingly, rooms of one apartment unit may be disposed above or below rooms of another apartment unit. For example, two of the bedrooms of a three-bedroom apartment would typically be disposed above, or below, the living room and kitchen, while a third bedroom would be disposed above, or below, the living area of another apartment.

In accordance with a concomitant feature of the invention, all of the apartment units have at least two outside exposure walls. More particularly, the simplex apartments offer cross-ventilation, and the sleeping levels of the duplex apartments offer through-ventilation.

Other features which are considered as characteristic for the invention are set forth in the appended claims.

Although the invention is illustrated and described herein as embodied in a building structure, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENT

Figure 1:
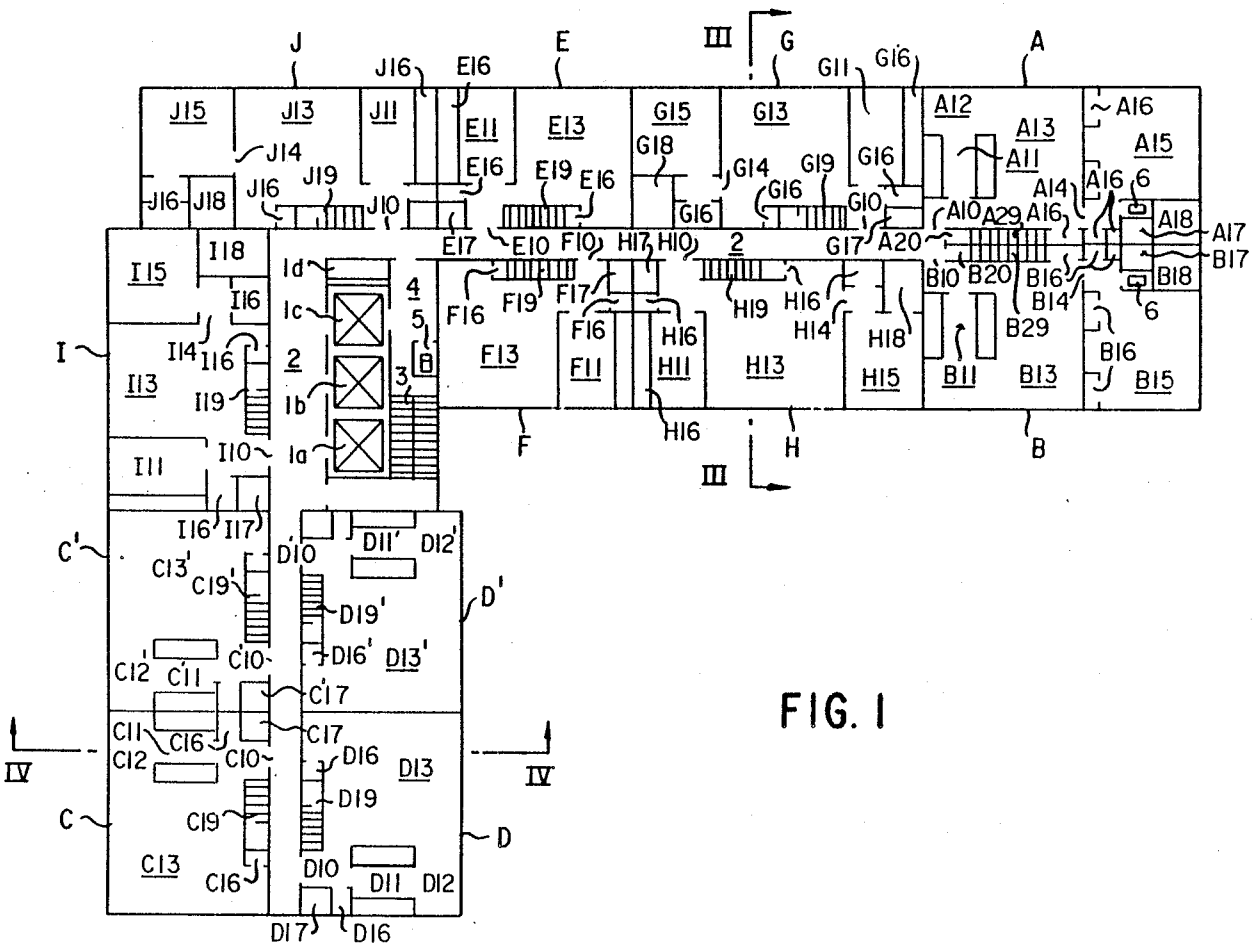
FIG. 1 is a top plan view of the "living level" of one wing of a U-shaped apartment building.
Figure 2:
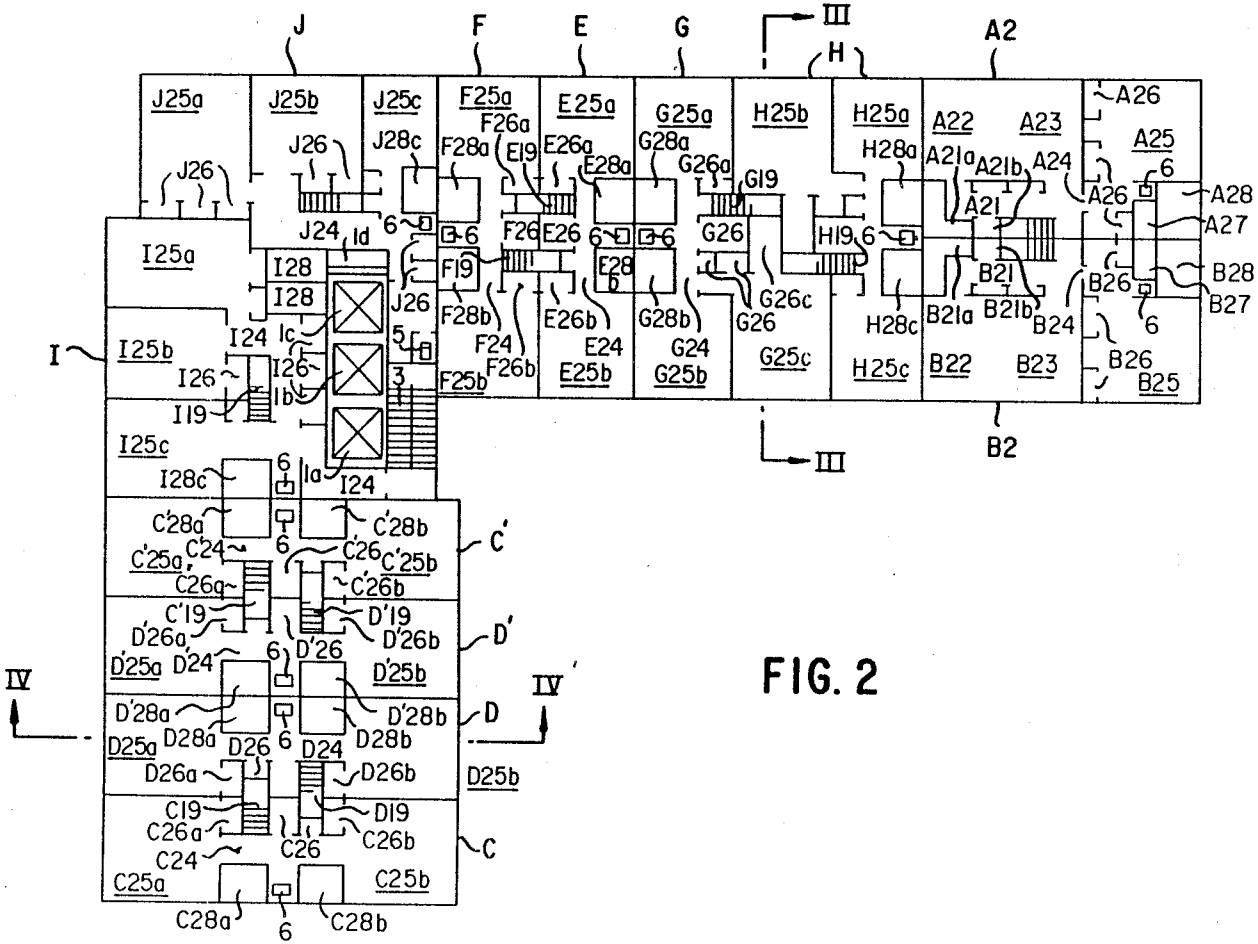
FIG. 2 is a top plan view of the "sleeping level" of one wing of a U-shaped apartment building.

Referring now to the figures of the drawing in detail it is noted that the living level depicted in FIG. 1 and the sleeping level depicted in FIG. 2 must be viewed as a unit in that they contain various parts of mutual apartments, whose "living areas" are shown in FIG. 1 and whose corresponding "sleeping areas" are shown in FIG. 2. These FIGS. 1 and 2 are related in that at least portions of the sleeping level of an apartment shown in FIG. 2 must be disposed above the living level of the respective apartment shown in FIG. 1. The vertical sucession of the living and sleeping levels, however, is interchangeable, which means that a sleeping level may be disposed above the corresponding living level as well as below it. Accordingly, in the description of the drawings, the expressions "above" and "below" may be exchanged in order to describe an embodiment where the sleeping level is disposed below the living level.

Referring now, particularly, to FIG. 1 of the drawing, there is seen a wing depicted, which is a mirror image of a nonillustrated wing and which includes two simplex units A and B, the "living levels" of ten duplex units C through J, C' and D', and a public corridor 2. Elevators 1*a*, 1*b* are passenger elevators with doors opening onto the public corridor 2. The elevator 1*c* is a service elevator whose door opens onto a public staircase landing 4. Public stairs 3 connect the living levels, i.e. every other level of the multi-story building, with a door opening onto the public corridor 2. Also disposed in the area of the public stairs 3 is a waste chute 5, which opens only on the living levels. The elevator shaft also features a vent.

The corridor 2 leads to several apartment units A through J which are accessible from the corridor 2 through doors A10, B10, C10, etc. The apartments A through J, C' and D', are units ranging in size from 1 bedroom/1½bath to 4 bedroom 3½ bath units.

Apartment A is a simplex unit, i.e. a single-story unit, located on the same level as the public corridor 2. This apartment, which is a 1 bedroom/1½ bathroom unit, is accessible directly from the corridor 2 through a door A10. Unit A includes a kitchen A11, a dining area A12, a living room A13 and a bedroom A15. A door A14 leads from the living room A13 to the bedroom A15. FIG. 1 shows five closets A16, three of which may be disposed arbitrarily along the wall between the living room A13 and the bedroom A15. The third closet A16 is disposed half-way below a staircase A29 connecting the public corridor 2 to an apartment A2 (shown in FIG. 2), which is located directly above the apartment A. A bathroom A18 of the unit A has an access door from the bedroom A15. Also shown in FIG. 1, accessible from the foyer area A14 connecting the living room A13 with the bedroom A15, is a washer/dryer assembly 6.

An apartment unit B is a mirror image of the unit A. This apartment is accessible through a door B10; one of its four closets B16 is partly located below a staircase B29 leading from the public corridor 2 to a unit B2 directly above the unit B.

Units C, C', D and D' are identical duplex units, each with 2 bedrooms and 2½ baths. Unit C, a two-story apartment unit, is accessible from the public corridor 2 through a door C10. Its living level, which is shown in FIG. 1, includes a kitchen C11, a dining area or alcove C12 and a living room C13. A guest bathroom C17 is located next to the entrance door C10 and next to a closet C16. A second closet C16 is located under a stairway C19 leading to the upper level or sleeping level of the unit C (shown in FIG. 2).

A unit D is located directly across the public corridor 2 from the unit C. The unit D is a perfect replica of the unit C, but it is rotated through 180° with respect to the apartment unit C. The same relationship holds between the units C' and D', of which the former is a mirror image of the unit C and the latter is a mirror image of the unit D. The respective sleeping levels of units C, C', D and D', which are depicted in FIG. 2, are accessible via the staircases C19, C19', D19 and D19', respectively.

Units E and F are identical duplex units, each with 2 bedrooms and 2½ bathrooms. Unit E, a two-story apartment unit, is accessible from the public corridor 2 through a door E10. Its living level, which is shown in FIG. 1, features an eat-in kitchen E11, a living room E13 and a guest bathroom E17. A closet E16 is disposed in the area between the kitchen E11 and the bathroom E17. A second closet E16 is disposed under a staircase E19 leading from the living level of the apartment unit E to its sleeping level, which is depicted in FIG. 2.

A unit F is located directly across the public corridor 2 from the apartment unit E. The unit F is a perfect replica of the unit E, but it is rotated through 180° with respect to the apartment unit E. The unit F features a staircase F19 which accesses its sleeping level, which is shown in FIG. 2.

Units G and H are identical duplex units, each with 4 bedrooms and 3½ bathrooms, one being rotated with respect to the other through 180°. Unit G is accessible from the public corridor 2 through a door G10. On its living level, which is shown in FIG. 1, unit G features an eat-in kitchen G11 with a range of closets G16 disposed therein, a living room G13, a bedroom G15, a "full" bathroom G18 and a guest bathroom G17. The area containing the bedroom G15 and the bathroom G17 and a walk-in closet G16, may be partitioned off from the living area by a door G14 and a small hallway area with doors G14 to the bedroom G15, the bathroom G17 and the closet G16. Two additional closets G16 are disposed between the kitchen G11 and the guest toilet G17 and below a staircase G19 which leads to the "sleeping level", respectively.

An apartment unit H is located directly across the public corridor 2 from the apartment unit G. The unit H is a perfect replica of the unit G, but it is rotated through 180° with respect to the apartment unit G. The unit H also features a staircase H19 which leads to its sleeping level shown in FIG. 2.

The living level of a unit I is identical to units G and H, except that it is a mirror image thereof. The apartment I is located near the elevators 1 and is accessible from the public corridor 2 through a door I10, which is located across the corridor 2 from the passenger elevator 1*a*.

The apartment J is also a 4 bedroom/3½ bathroom unit, and its living level is layed out very similar to that of the unit G; a difference between these two units is that unit J is disposed in a corner of the apartment building, so that a bedroom J15 has two outside walls while the bedroom G15 has only one outside wall. Another difference is that a closet and bathroom cluster J16 and J18 of unit J is accessible directly from the bedroom J15, while the apartment G features a small foyer area G14 connecting the living room G13 with the bedroom G15, the closet G16 and the bathroom G18.

FIG. 2 shows a wing which is a mirror image of a nonillustrated wing and which includes two simplex units A2 and B2, and the "sleeping levels" of ten duplex units C through J, C' and D'.

The apartment units A2 and B2 are two simplex apartments disposed directly above apartments A and B respectively. As pictured in FIG. 1, the unit A2 is accessed from the public corridor 2 through a door A20 and via the staircase A29, which is illustrated in both FIGS. 1 and 2. The main living area of the unit A2 has a kitchen A21 featuring a corner counter assembly A21*a* and a pantry A21*b*, a dining alcove A22 and a living room A23. A door A24 leads from the living room A23 to a bedroom A25. A bathroom A28 can be accessed from the bedroom A25. The unit A2 also features several closets A26. Also illustrated in FIG. 2 is a washer/dryer assembly 6 which utilizes the same, nonillustrated, plumbing stack and vent line as the washer/dryer 6 of the apartment A directly below.

The apartment unit B2 is essentially identical with the unit A2, of which it is a mirror image. The washer/dryer assembly 6 of unit B2 utilizes the same plumbing stack as the unit B directly below. The same plumbing stack and vent line is also utilized for the bathrooms B18 and B28.

Further shown in FIG. 2 are the sleeping levels of the duplex apartments C to J, C' and D'. As already mentioned, the unit C is a 2 bedroom/2½ bathroom apartment, whose two bedrooms C25*a*, C25*b* and two "full" bathrooms C28*a*, C28*b* are illustrated in FIG. 2. The staircase C19, which is shown in FIGS. 1 and 2, leads from the living level of the apartment C to its sleeping level, where it opens unto a hallway C24. This hallway C24 leads to the bedrooms C25*a* and C25*b*. These bedrooms feature one closet each, C26*a* and C26*b* respectively. Bathrooms C28*a* and C28*b* may be accessible from either the hallway or the respective bedroom C25*a* or C25*b*. Also shown in FIG. 2 is a washer/dryer assembly 6 disposed between the bathrooms C28*a* and C28*b*, a small closet above the staircase D19, and a walk-in closet C26.

When comparing the layout of the two levels of unit C as illustrated in FIGS. 1 and 2, it can be seen that a large portion of the sleeping level of the unit C is disposed above the living level of the unit D. The bedroom C25*b* and its closet C26*b* are located directly above the kitchen D11 and the living room D12, while the second bedroom C25*a*, the corresponding closet C26*a* and the bathroom C28*a* are disposed above the living room C13. A large portion of the bathroom C28*b* is disposed above the guest bathroom D17 and the closet D16. The remaining portion of the bathroom C28*b*, together with another, though smaller, portion of the sleeping level of the unit C, namely the washer/dryer assembly 6 and the central walk-in closet C26, are disposed above the public corridor 2.

The unit D is a perfect replica of the unit C, on both the living and sleeping levels, but it is rotated through 180° with respect to the apartment unit C. The sleeping level of the unit D, therefore, "overlaps" the kitchen C11 and the dining room C12 of the apartment C.

The same relationship holds between the units C' and D' on both the sleeping and living levels; the unit C' is a mirror image of the unit C, with its sleeping level overlapping portions of the living level of the unit D', and the unit D' is a mirror image of the unit D, with its sleeping level overlapping portions of the living level of the unit C'.

The sleeping levels of the units D and D', which extend from one outside wall of the building to another, are disposed back-to-back. This makes it possible that the "upstairs" bathrooms of the units D and D', namely D28*a*, D'28*a*, D28*b* and D'28*b*, all utilize one and the same plumbing and vent stack. Also connected to the same plumbing stack are the washer/dryer assemblies 6 of both apartments D and D'.

Apartment units E and F are very similar to units C and D, as well as C' and D'. Consequently, their floor plan layout and the arrangement of the living and sleeping levels with respect to one another corresponds to that of units C and D, as described above. A bedroom F25*b* with a bathroom F28*b* and a closet F26*b* is disposed above the living room F13, while a bedroom F25*a* with a bathroom F28*a* and a closet F26*a* is disposed directly above the kitchen E11, the closet E16 and the guest bathroom E17 of the apartment unit E. Correspondingly, a bedroom E25*a* is located above the living room E13 of the unit E, while a bedroom E25*b* on the sleeping level of the unit E is disposed above the kitchen F11 of the apartment unit F.

As mentioned above, the apartments G and H are each 4 bedroom and 3½ bathroom units. The staircase G19 leads from the living level of the unit G to its sleeping level, which is shown in FIG. 2. From a landing and hallway G24, three bedrooms, namely G25*a*, G25*b* and G25*c*, can be reached. Bedrooms G25*a* and G25*b* each feature a bathroom, G26*a* and G26*b*, respectively, while the bedroom G25*c* features a large walk-in closet G26*c*. The sleeping level of the unit G also includes a washer/dryer assembly 6 and several closets G26 and G26*a*.

Bathrooms G28*a* and G28*b* share the same wall with bathrooms E28*a* and E28*b*. This layout and the fact that the washer/dryer assemblies are disposed in between the bathrooms G28*a* and G28*b* or E28*a* and E28*b*, respectively, makes only one plumbing and vent stack necessary for these four bathrooms and two washer/dryer assemblies. Moreover, as can be seen when viewing FIGS. 1 and 2 together, the same plumbing and vent stack is also accessed from the bathroom G18 and the guest bathroom H17 on the living level.

This "pairing" of apartment units is provided throughout the floor plan. Correspondingly, the sleeping levels of units D and D', C' and I, J and F, E and G are all arranged back-to-back, so as to offer this advantageous economical usage of plumbing and vent stacks. The kitchens and bathrooms on the living level are arranged in a similar manner, so as to share—wherever possible—a mutual plumbing and vent stack.

The apartment unit H is identical to the unit G with their axes of orientation rotated through 180° with respect to each other. Two bedrooms H25*a* and H25*b* are disposed above the living room G13 and the kitchen G11, while a third bedroom H25*c* on the sleeping level of unit H is disposed above the bedroom H15 on the living level of the same apartment unit H. Two bathrooms H28*a* and H28*c* as well as the washer/dryer assembly 6 of unit H share a wall with the kitchens A22 and B22. This, again, makes only one plumbing and vent stack necessary for several users.

Units I and J, whose sleeping levels are shown in FIG. 2, are also 4 bedroom/3½ bathroom apartments. The stairway I19, which is shown in both FIGS. 1 and 2, leads to a hallway I24. From this hallway I24, three bedrooms, I25*a*, I25*b* and I25*c*, can be accessed. Also disposed along the hallway I24 are several closets I26 and a washer/dryer assembly 6 adJacent to a bathroom I28*c*. The hallway I24 also has a door to the public stairs 3.

As shown in FIGS. 1 and 2, the unit J features approximately the same amount of square footage of living space as the unit I. The sleeping level of unit J, as shown in FIG. 2, is an approximate mirror image of that of unit I, the two apartments featuring the same number of bedrooms and bathrooms and approximately the same amount of storage space in the closets I26 and J26. Also, the bathroom I28*c* and the washer/dryer assembly of unit I share a wall with the bathrooms C'28*a*, C'28*b* and the washer/dryer 6 of apartment C', so as to utilize only one plumbing and vent stack for several users. The same holds for a bathroom J28*c* and the washer/dryer 6 of the unit J, which share a plumbing stack with the bathrooms F28*a*, F28*b* and the washer/dryer 6 of the unit F.

The elevators 1*a*, 1*b* and 1*c* do not open on the sleeping level shown in FIG. 2. This makes it possible to dispose the closets I26, the bathroom I28 and a bathroom J28, and the hallways I24 and J24 directly adjacent to the elevator shaft, which leads to a maximum usage of the available space.

Figure 3:
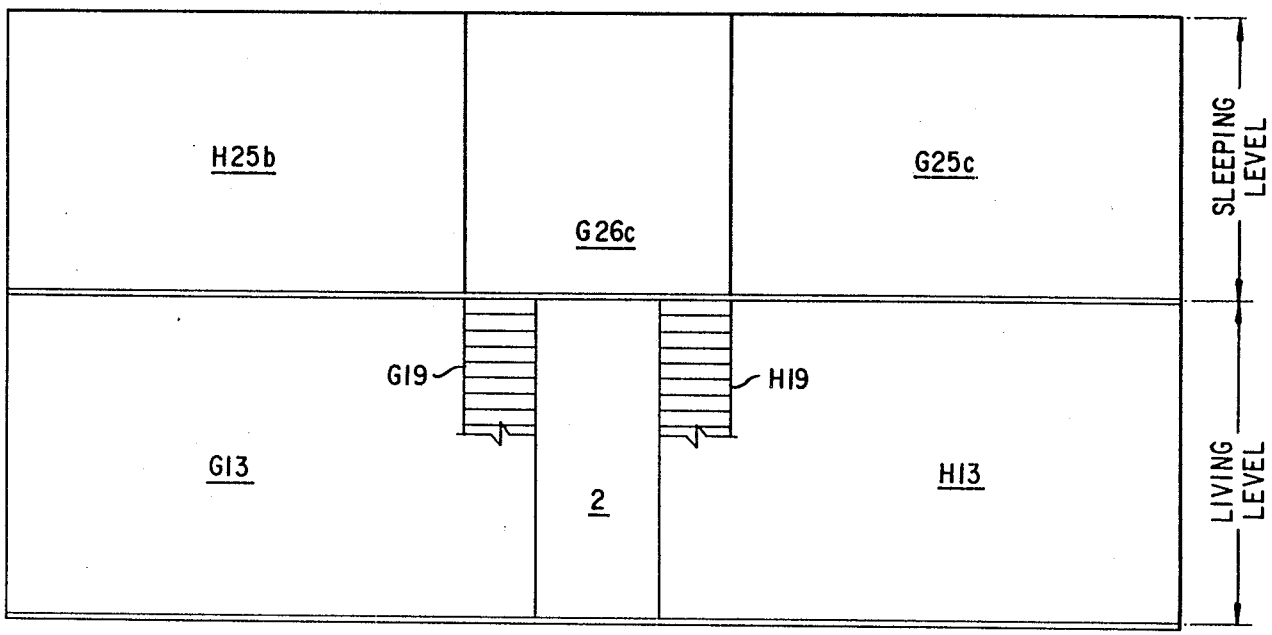
FIG. 3 is a vertical-sectional view through both the living and sleeping levels of two apartment units, taken along the line III—III in FIGS. 1 and 2, in the direction of the arrows.

FIG. 3 shows a vertical-sectional view through the living levels and sleeping levels of the units G and H, as indicated by the dashed lines in FIGS. 1 and 2.

As shown in FIG. 3, the bedroom G25*c* is located above the living room H13, and the bedroom H25*b* is located above the living room G13. The walk-in closet G26*c* is disposed above the stairways G19, H19 and the public corridor 2.

Figure 4:
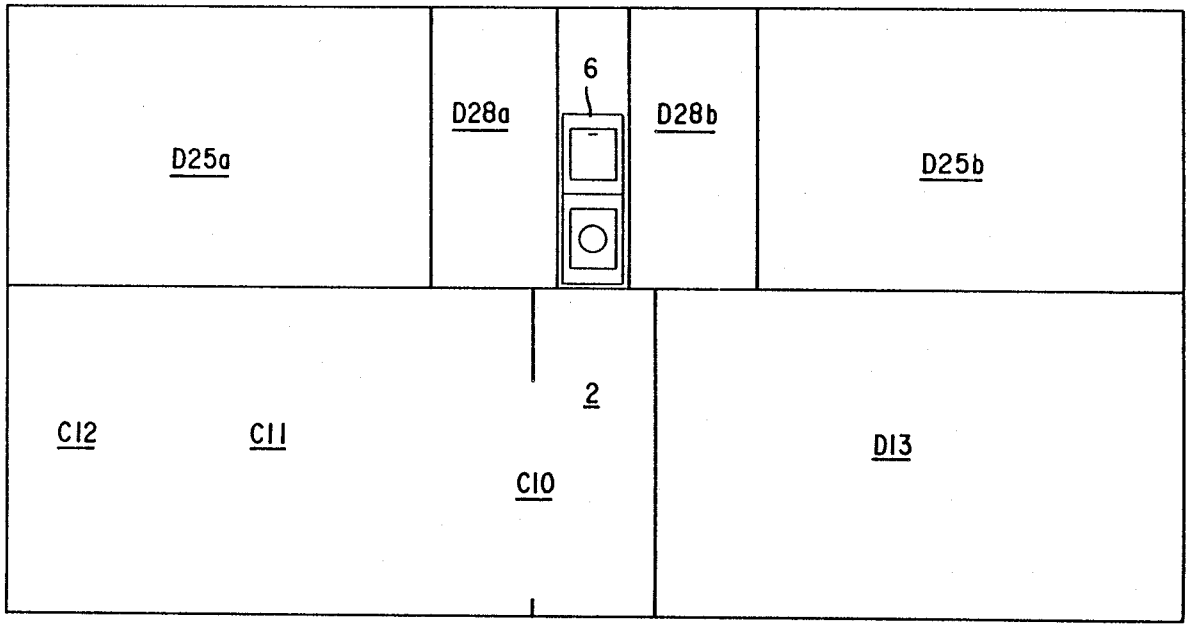
FIG. 4 is a vertical-sectional view through both the living and sleeping levels of two other apartment units, taken along the line IV-IV in FIGS. 1 and 2, in the direction of the arrows.

FIG. 4 shows a vertical-sectional view through the units C and D, as indicated by the dashed lines in FIGS. 1 and 2. Accordingly, FIG. 4 shows a vertical cross-section of the living level of FIG. 1 and a vertical cross-section of the sleeping level of FIG. 2.

FIG. 4 illustrates the "overlapping" feature between the units C and D, as described above. FIG. 4 shows that the bedroom D25*b* is located above the living room D13, while the bedroom D25*a* is located above the kitchen C11 and the dining area C12. The main portion of the bathroom D28*a* is disposed above the area next to the entrance C10 of the apartment C, while a smaller portion is disposed above the public corridor 2. Also disposed directly above the public corridor 2 are the washer/dryer assembly 6 on the sleeping level of the unit D and a small portion of the bathroom D28*b*. The larger portion of the bathroom D28*b* is located above the living room D13 and the access area to the closet D16 below the staircase D19.

I claim:

1. A multi-story building structure, comprising at least one pair of levels, each pair of levels including one sleeping level, one living level and one public corridor on said living level, duplex apartments each having at least one room on said sleeping level and at least one room on said living level of a respective pair of levels, and an elevator system including two elevators, each of said elevators having a respective stop disposed at each one of said public corridors and each of said elevators skipping said sleeping levels.

2. The multi-story building structure according to claim 1, wherein said at least one pair of levels is in the form of at least two pairs of levels, said two pairs having said sleeping levels thereof disposed one above the other.

3. The multi-story building structure according to claim 1, wherein said at least one pair of levels is in the form of at least two pairs of levels, said two pairs having said living levels thereof disposed one above the other.

4. The multi-story building structure according to claim 1, wherein each of said public corridors is disposed substantially centrally on one of said living levels defining regions of said living levels between said corridors and outer walls of the building structure, all of said rooms being disposed in said regions.

5. The multi-story building structure according to claim 1, including plumbing stacks disposed in walls between adjacent apartment units, said plumbing stacks including at least one soil line and one vent line, and said plumbing stacks being connected to a plurality of apartments.

6. The multi-story building structure according to claim 1, including stairs, at least one of said sleeping levels including a one-story simplex apartment being accessible from said public corridor via said stairs.

7. The multi-story building structure according to claim 1, wherein at least one of said living levels includes a one-story simplex apartment, said simplex apartment being accessible from said public corridor.

8. The multi-story building structure according to claim 1, wherein each apartment has rooms including at least one bedroom on the sleeping level, said at least one bedroom of one apartment being disposed vertically above a room on the living level of another apartment.

9. The multi-story building structure according to claim 1, wherein each apartment has rooms including at least one bedroom on the sleeping level, said at least one bedroom of one apartment being disposed vertically below a room on the living level of another apartment.

10. The multi-story building structure according to claim 1, wherein the sleeping levels of each duplex apartment have at least two outside exposure walls.

11. The multi-story building structure according to claim 1, including simplex apartments each having at least two outside exposure walls.

12. The multi-story building structure according to claim 1, wherein each of said living and sleeping levels includes at least one simplex apartment.

13. The multi-story building structure according to claim 4, including plumbing stacks disposed in walls between adjacent apartment units, said plumbing stacks including at least one soil line and one vent line, and said plumbing stacks being connected to a plurality of apartments.

14. The multi-story building structure according to claim 13, including stairs, at least one of said sleeping levels including a one-story simplex apartment being accessible from said public corridor via said stairs, and at least one of said living levels including a one-story simplex apartment, said simplex apartment being accessible from said public corridor.

15. The multi-story building structure according to claim 13, wherein each duplex apartment has rooms including at least one bedroom on the sleeping level, said at least one bedroom of one duplex apartment being disposed vertically above a room on the living level of another duplex apartment.

16. The multi-story building structure according to claim 13, wherein each apartment has rooms including at least one bedroom on the sleeping level, said at least one bedroom of one apartment being disposed vertically below a room on the living level of another apartment.

17. The multi-story building structure according to claim 13, wherein the sleeping levels of each duplex apartment have at least two outside exposure walls.

18. The multi-story building structure according to claim 14, wherein said simplex apartments each have at least two outside exposure walls.

19. The multi-story building structure according to claim 4, wherein each of said living and sleeping levels includes at least one simplex apartment.

20. The multi-story building structure according to claim 19, wherein said simplex apartments each have at least two outside exposure walls.

* * * * *